US005180439A

United States Patent [19]

Allison

[11] Patent Number: 5,180,439

[45] Date of Patent: Jan. 19, 1993

[54] METHOD AND APPARATUS FOR CLEANING & RINSING CARPETS

[76] Inventor: Steve D. Allison, 921 Sunny La., Raleigh, N.C. 27603

[21] Appl. No.: 739,250

[22] Filed: Aug. 1, 1991

[51] Int. Cl.[5] ..... B08B 3/04; A47L 11/34

[52] U.S. Cl. ..... 134/21; 15/322; 15/410; 134/26; 239/305; 239/310

[58] Field of Search ..... 15/321, 322; 239/305, 239/310

[56] References Cited

U.S. PATENT DOCUMENTS

| | | | |
|---|---|---|---|
| 1,082,159 | 12/1913 | Kelley | 239/305 X |
| 3,101,505 | 8/1963 | Belicka et al. | 15/320 |
| 3,974,541 | 8/1976 | Silvis et al. | 15/322 X |
| 4,154,578 | 5/1979 | Bane | 15/321 X |
| 4,218,900 | 8/1980 | Caplan et al. | 15/322 X |
| 4,333,203 | 6/1982 | Yonkers | 15/322 X |
| 4,458,377 | 7/1984 | Frohbieter | 15/321 X |
| 4,485,518 | 12/1984 | Kasper | 15/322 |

*Primary Examiner*—Chris K. Moore
*Attorney, Agent, or Firm*—Rhodes, Coats & Bennett

[57] ABSTRACT

The present invention is a carpet cleaning wand having containers for holding cleaning solution and rinsing solution mounted thereon, a hot water line, a vacuum head and a dispensing nozzle. The hot water line includes a mixing valve for infusing cleaning or rinsing solution into hot water flowing through the hot water line. A control valve is connected between each of the solution containers and the mixing valve and allows an operator to alternately select and mix either cleaning solution or rinsing solution with hot water flowing through the hot water line so that the same may be applied to the carpet or other surface being cleaned.

10 Claims, 2 Drawing Sheets

METHOD AND APPARATUS FOR CLEANING & RINSING CARPETS

FIELD OF THE INVENTION

The present invention relates to carpet cleaning devices and more particularly to a wand-type carpet cleaning device that is capable of both cleaning and rinsing the carpet.

BACKGROUND OF THE INVENTION

By far the most common apparatus used by professional carpet cleaners is the carpet cleaning wand. The wand is a hand-held device designed to be pushed and dragged across carpet. At the forward portion of the wand where it engages the carpet is formed a vacuum head. This vacuum head is provided with a high powered suction force created by an external air pump which is connected to the wand by a vacuum line. Behind the vacuum head is a dispenser nozzle. In operation, hot water, hot water with cleaning solution, or hot water with rinse solution are sprayed onto the carpet from the nozzle as the wand is pushed forward and then fluid and debris freed by the fluid are removed from the carpet as the vacuum head is pulled back. To fully wet and clean, the wand is usually moved forward and back twice for each area of carpet. In present methods, hot water or hot water and solution are pumped to the wand through a hot water line from a truck or similar station where hot water and fluid pressure are generated. Cleaning or rinsing solutions are mixed with the hot water either prior to the pump or in the hot water line between the pump and the wand.

In most applications, only hot water with cleaning solution is applied to the carpet. Prior to the advent of stain resistant and soil retardant carpets, no rinse step was used because the added effort and expense associated with using a second solution or pure hot water rinse made such a step uneconomical. When cleaning stain resistant carpets, however, manufactures of these carpets have stated that the use of a single cleaning step without a subsequent rinse step is inadequate. Residue of the cleaning solution left on the carpet fibers after vacuuming negates the stain resistant and soil retardant properties of the carpet. It is therefore desirable to apply a rinsing solution or pure hot water step after the cleaning solution step.

Using the conventional carpet cleaning apparatus, the addition of a rinse step effectively doubles the time, effort, and expense required to clean a carpet. The entire carpet is first cleaned in the manner described above, followed by a rinsing of the entire carpet. Because cleaning or rinsing solution is mixed with the hot water in the line or before the pump, it is impractical to alternate between cleaning solution and rinsing solution or between cleaning solution and pure hot water.

A second method has been developed which uses a hand-held cleaning solution sprayer. A solution is first sprayed onto the carpet (without vacuum), followed by rinsing and vacuuming with the wand. This method reduces the cleaning step so that it is economically feasible to clean and rinse. But, this method still requires two separate passes (one to spray and one to rinse). Additionally, two separate implements (the sprayer and the wand) are required and there is the danger of overwetting the carpet with the sprayer because the user cannot visually control the amount of the cleaner.

Therefore, there exists a need for a wand-type apparatus and a method for cleaning and rinsing carpets which is effective, efficient and cost-effective.

SUMMARY AND OBJECTS OF THE INVENTION

The present invention is a method and apparatus for cleaning carpet which provides for effective, efficient, and cost effective cleaning and rinsing of carpets. The present invention precludes the need for separate passes for cleaning and rinsing and avoids other shortfalls of prior carpet cleaning and rinsing methods and apparatuses.

The present invention includes a conventional carpet cleaning wand having a vacuum head and a dispenser nozzle. Mounted on the wand are a pair of storage containers designed to hold cleaning and rinsing solutions. The hot water line is equipped with a multi-positional venturi-type valve. Transfer lines provide passage for the solutions from the storage canisters to the valve. A selected solution may be mixed with the hot water prior to exiting the nozzle by positioning the valve such that solution may flow into the hot water line. Solution is drawn from its transfer line by a pressure gradient between the high velocity hot water and low velocity solution. The valve may be positioned such that pure hot water exits the nozzle as well.

An operator may use the apparatus of the present invention in the following manner. In the first forward stroke, the valve is positioned such that hot water with cleaning solution is applied to the carpet. This mixture and dirt from the carpet is removed by the vacuum of the first back stroke. In the second forward stroke, the valve is repositioned such that hot water with rinsing solution or pure hot water is applied to the carpet. In the second backstroke, the pure hot water or rinsing solution with hot water is removed by the vacuum. As a result, the carpet is left clean and residue free. Because two passes are made, one with rinsing solution and one with cleaning solution, there is no need for two passes with cleaning solution and therefore the amount of cleaning solution used is cut by half.

It is an object of the present invention to provide a wand-type apparatus and method for cleaning and rinsing carpets that is effective, efficient, and cost-effective. It is an object of the present invention to provide a carpet cleaning apparatus which may be used to conveniently apply cleaning solution or rinsing solution or pure hot water alternately.

It is an object of the present invention to provide a carpet cleaning apparatus of the character referred to above which may be adapted for use with conventional carpet cleaning wands.

It is an object of the present invention to provide a carpet cleaning wand having means for mixing hot water and cleaning solution or rinsing solution at the wand.

DETAILED DESCRIPTION OF THE INVENTION

Figure 1:
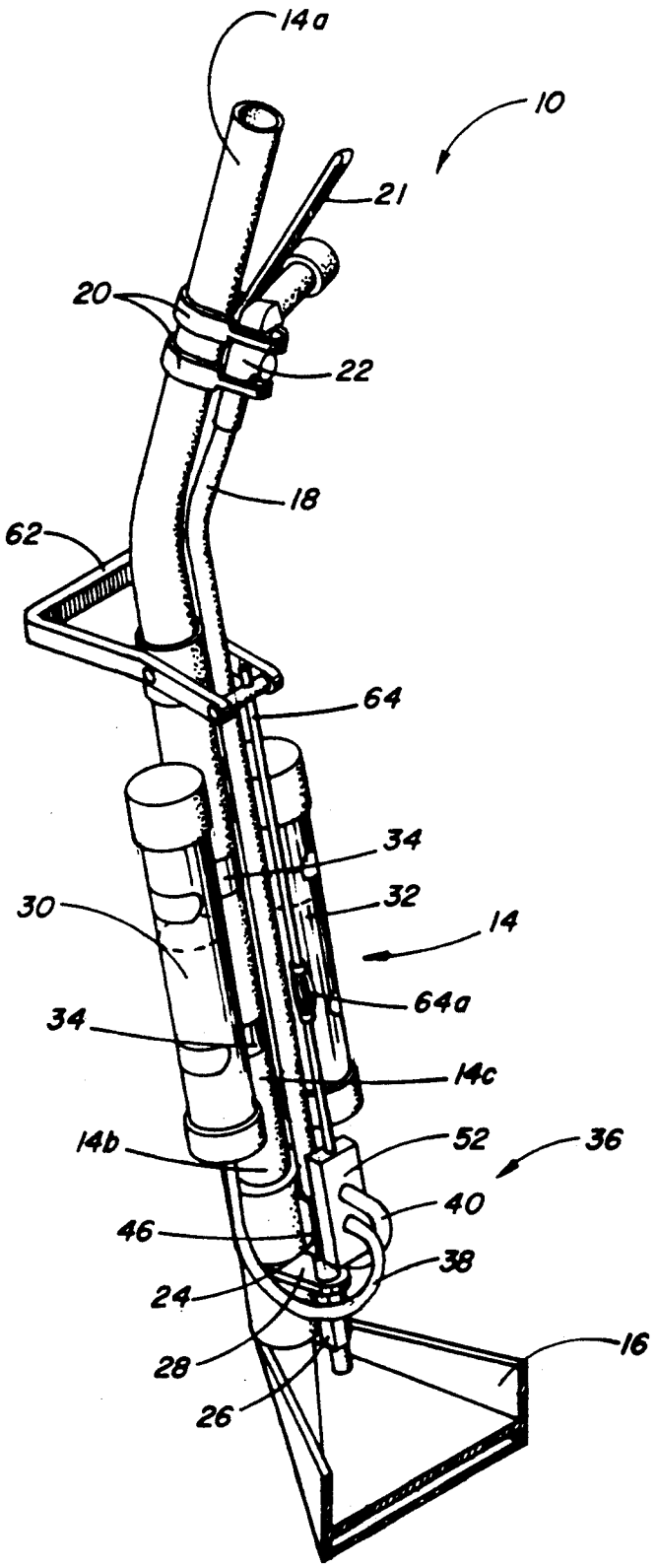
FIG. 1 is a perspective view of the cleaning apparatus of the present invention, particularly illustrating a wand having both cleaning and rinsing containers mounted thereon.

With further reference to the drawings, the hot water extraction wand of the present invention is shown therein and indicated generally by the numeral 10. As will be appreciated from subsequent portions of the disclosure, wand 10 is designed to mix either cleaning solution or rinsing solution with hot water at the wand site for application to carpet or to any other surface being cleaned. More particularly, wand 10 is designed such that the operator may perform both a cleaning operation and a rinsing operation with the wand itself. This enables the carpet or other surface being cleaned to be both cleaned and rinsed in one operation.

Turning to a more detailed discussion of the wand 10, it is seen that the same includes an elongated pipe or main frame structure 14. Pipe or frame 14 includes a handle end portion 14*a*, an intermediate portion 14*c*, and a lower terminal end portion 14*b*. Pipe 14 is hollow and consequently serves as a conduit for a vacuum system (not shown) that is typically located remote from the wand and connected to the handle end portion 14*a* of the wand through a vacuum hose (not shown).

Secured to lower terminal end portion 14*b* of frame or pipe 14 is a conventional vacuum head 16.

Secured to wand 10 and extending from handle portion 14*a* to lower terminal end portion 14*b* is a hot water line 18. Hot water line 18 is designed to be connected to a remote hot water source (not shown) through a connecting hot water line (also not shown). Secured to hot water line 18 about handle end portion 14*a* is an on/off control valve 22. Control valve 22 is secured to wand 18 by a pair of connecting brackets 20. In addition, on/off control valve 22 includes a hand actuated handle 21 that projects from the on/off control valve and which can be conveniently actuated by the wand operator.

Secured to the lower remote end of hot water line 18 is a high pressure nozzle 26. Nozzle 26 is of the conventional type used on carpet cleaning wands, and as seen in FIG. 1, it is supported adjacent vacuum head 16 by a support flange 28 that extends from the wand.

Figure 2:
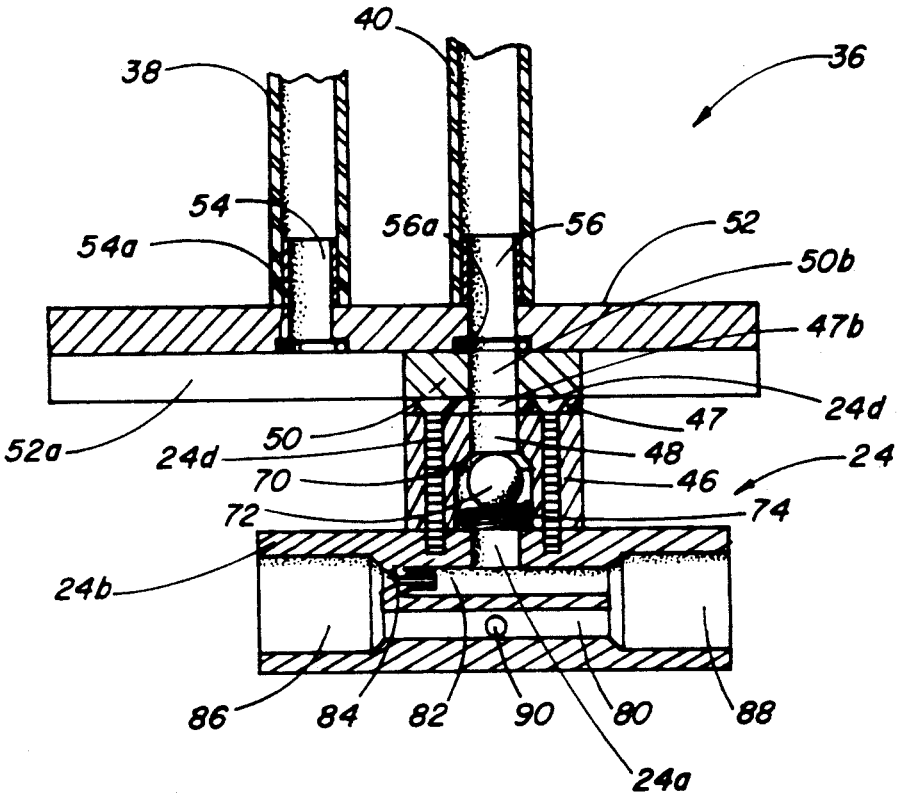
FIG. 2 is a longitudinal suctional view of the mixing and control valves that forms a part of the present invention.
Figure 3:
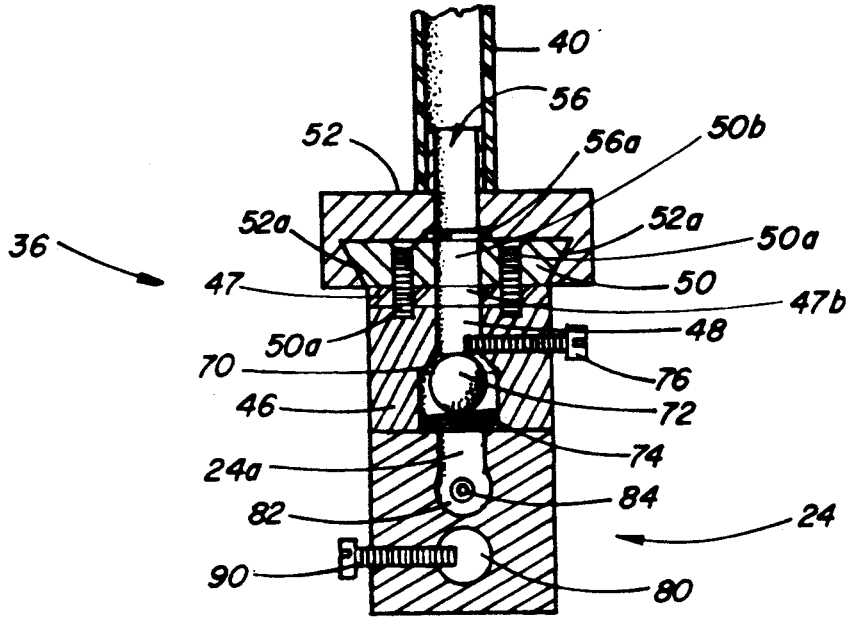
FIG. 3 is a transverse sectional view of the mixing and control valve forming a part of the present invention.

Interconnected between hot water line 18 and spray nozzle 26 is a mixing valve indicated generally by the numeral 24 and shown in particularly in FIGS. 2 and 3. Mixing valve 24 includes an outer housing 24*b* and a fluid passageway extending completely through the valve. Viewing the passageway, as seen in FIG. 2, it is seen that the same comprises two relatively large passageways 86 and 88 disposed at opposite ends of the valve 24. Conduits 86 and 88 effectively form the inlet and outlet of mixing valve 24. Interconnected between end conduits 86 and 88 is a pair of relatively small passageways or conduits 80 and 82. Formed about the inlet end of conduit 82 is a venturi or restricting orifice 84. A mixing or secondary inlet 24*a* is formed in the top of mixing valve 24 and extends downwardly to upper passageway 82. In order to adjust the flow of hot water through mixing valve 24, lower passageway 80 (as viewed in FIG. 2), includes an adjustment screw 90 which functions to vary the effective diameter of the lower passageway 80 and therefore does in fact control and vary the flow of water through the mixing valve 24.

As pointed out above, the basic principle behind the present invention is to provide a cleaning system where the operator can alternatively clean and rinse with wand 10 without having to change solutions at a remote source. Therefore, wand 10 is provided with two containers: a cleaning solution container 30 and a rinsing solution container 32. Containers 30 and 32 are mounted to the intermediate portion 14*c* of elongated pipe or frame 14 by a series of brackets 34.

Containers 30 and 32 have a discharge end and extending from the discharge ends of the containers are a cleaning solution supply line 38 and a rinse solution supply line 40.

Supply lines 38 and 40 extending from containers 30 and 32 are connected to a control valve, indicated generally by the numeral 36, which is in turn connected to mixing valve 24. The function of control valve 36 is to alternately direct cleaning solution and rinsing solution into mixing valve 24 where the respective solutions mix with hot water passing through mixing valve 24. It is appreciated that containers 30 and 32 must be appropriately vented in order that solution may pass therefrom into the supply lines 38 and 40. Thus, containers 30 and 32 are provided with vents (not shown) and it is contemplated that the vents would be incorporated with one-way check valve to prevent solution from leaking from the containers due to particular position assumed by the wand 10. It is contemplated that cleaning and rinsing solutions may be supplied in disposable, pliable cartridges adapted to be inserted into containers 30 and 32, wherein containers 30 and 32 would include means for puncturing and forming a fluid-sealed engagement with the cartridges.

Control valve 36 basically comprises a valve block 46, a spacer 47, a dovetail head 50, and a slide member 52 (see FIGS. 2 & 3). Valve block 46 is secured to housing 24*b* of mixing valve 24 by a series of screws 24*d* that extend from housing 24*b* up through block 46 into spacer 47. Block 46 includes a central passageway 48 that includes a check valve incorporated therein. As seen in FIG. 2, the check valve is formed by a ball 72 that is biased by spring 74 against a ball seat 70. It is thus seen that the check valve prevents the flow of fluid from the mixing valve 24 into the block 46. However, the check valve permits flow of fluid from the block 46 into the mixing valve 24.

Communicatively connected with passageway 48 is passageway 47*b* formed in spacer 47. As seen in FIG. 3, spacer 47 is secured to both dovetail head 50 and block 46 by a pair of screws 50*a*.

Dovetail head 50 includes a central passageway 50*b* that aligns with passageways 47*b* and 48. In addition, dovetail head 50 includes a pair of dovetail or bevelled outer sides Slide member 52 is movably mounted on dovetail head 50. Slide member 52 includes a pair of inwardly directed dovetail sides 52*a* that mate with the dovetail sides of dovetail head 50 and which tightly secure slide member 52 to dovetail head 50, but permit slide member 52 to be moved back and forth on dovetail head 50. A pair of openings 54 and 56 are formed in the top of slide member 52. Openings 54 and 56 have O-rings 54*a* and 56*a* seated therein. As can be seen in the drawings, the respective openings 54 and 56 formed in slide member 52 can be aligned with dovetail head 50. Thus, by sliding slide member 52 back and forth, each of the openings 54 and 56 can be appropriately aligned with the passageways 50*b*, 47, 48 and 24*a* such that fluid passing through either opening 54 or 56 can be channeled into upper conduit 82 or mixing valve 24. Opening 54 is communicatively connected to supply line 38 while opening 56 is connected to supply line 40. The flow of fluid through control calve 36 can be controlled by set screw 76 which projects through block 46 and into passageway 48.

To actuate control valve 36, there is provided a connecting rod 64 that is secure to slide member 52 and which extends therefrom to where the same connects to a pivotally mounted handle 62. In order to adjust control valve 36 and particularly the stroke of the interconnecting linkage mechanism, connecting rod 64 is provided with an intermediate toggle adjustment 64*a*. Therefore, by shifting or pivoting lever 62 back and forth, slide member 52 can be moved between two extreme positions. In one position, opening 54 is aligned with the various lower passageways of the control valve, and in the other position, opening 56 of slide member 52 is aligned with the same lower openings or passageways of control valve 36.

In use, to clean a selected area of carpet or other surface control lever 62 is positioned to where cleaning solution container 30 directs cleaning solution through line 38 through opening 54 and downwardly through the various lower passageways of the control valve. The steam or hot water passing through mixing valve 24 acts to induce cleaning solution through the control valve into mixing valve or structure 24. In particular, as hot water passes through venturi or jet 84, a pressure differential is created across control valve 36 and cleaning solution is induced from cleaning solution container 30 through control valve 36 into mixing valve 24. The mixed hot water and cleaning solution is dispersed onto the surface to be cleaned through nozzle 26. This is performed by one stroke of the wand. Next, the same area that has just been cleaned is vacummed by passing the wand over the area just cleaned while releasing handle 21 which effectively shuts off the flow of hot water through line 18 and consequently shuts off the flow of fluid from nozzle 26. To rinse that area clean, lever 62 is shifted to the other extreme position where supply line 40 leading from rinsing solution container 32 directs fluid through opening 56 on through control valve 36 into mixing valve 24. There the rinsing solution mixes with the hot water passing through the mixing valve and the mixed or combined solution is dispersed onto the area being cleaned. This rinsing solution rinses the carpet and removes unwanted cleaning residue from the surface being cleaned.

It should be appreciated that the rinsing step can be carried out by dispensing or dispersing hot water alone. Control valve 36 includes a central position that effectively encloses by the cleaning solution and the rinsing solution to the valve and simply allows hot water to pass through the mixing valve 24. Thus, this position can be utilized to rinse the surface being cleaned as well as utilizing the actual rinsing solution. In this case, the control valve is simply centered and the hot water passing through line 18 is used to carry out the rinsing operation.

Once the mixed rinsing solution has been dispersed onto the area being cleaned, the hot water supply is cut off by releasing handle 21 and the wand is pulled or pushed back over the rinsed area vacuuming the same in the process. This cleaning and rinsing process is continued by the operator until the entire area is cleaned. Thus it is appreciated that wand 10 of the present invention enables one to both clean and rinse in one basic operation using one cleaning device. Thus, the typical requirement of requiring two machines in two different operations is eliminated by the present invention.

The present invention may, of course, be carried out in other specific ways than those herein set forth without departing from the spirit and essential characteristics of the invention. The present embodiments are, therefore, to be considered in all respects as illustrative and not restrictive and all changes within the meaning and equivalency range of the appended claims are intended to be embrace therein.

What is claimed is:

1. A carpet cleaning apparatus comprising:

(a) a wand;

(b) a first solution container mounted on the wand for holding a cleaning solution;

(c) a second solution container mounted on the wand for holding a rinse solution;

(d) a supply line to be connected to a source of hot water;

(e) a dispensing nozzle mounted on the wand and connected to the supply line for applying hot water to the carpet;

(f) infusion means for selectively introducing cleaning solution and rinse solution into said hot water supply line for mixing with the hot water being applied to the carpet, said infusion means comprising:

(1) a mixing valve disposed in said hot water supply line; and (2) a control valve operatively connected between the mixing unit and the first and second solution containers, said control valve being movable between a cleaning position in which cleaning solution is supplied to the mixing unit, and a rinsing position in which rinsing solution is supplied to the mixing unit; and (g) a vacuum head mounted on the wand and connected to a vacuum source for removing liquid and debris from said carpet.

2. The carpet cleaning apparatus according to claim 1 wherein the control valve includes a valve block fixedly secured to the mixing valve and having a transfer passage formed therein a fluid communication with the mixing valve, and a slide member movably mounted on the valve block, said slide member having first and second inlet channels in fluid communication with the first and second solution containers, respectively, wherein the first and second inlet channels can be selectively aligned with the transfer passage in the valve block by moving the sliding member to selectively establish a fluid path from the first and second solution containers to the mixing valve.

3. The carpet cleaning apparatus according to claim 2 wherein the control valve further includes check valve means to restrict the flow of fluid from the mixing valve to the first and second containers.

4. The carpet cleaning apparatus according to claim 2 wherein the check valve means includes a ball, a ball seat formed in the transfer passage, and means for biasing the ball against the ball seat.

5. The carpet cleaning apparatus according to claim 1 wherein the mixing valve includes a primary passage through which the hot water flows and a secondary passage connected to the control valve, wherein the primary passage includes a restriction causing a reduction in pressure of the hot water which draws cleaning solution or rinse solution into the mixing valve through the secondary passage.

6. The carpet cleaning apparatus according to claim 5 wherein the control valve includes a valve block secured to the mixing valve and having a transfer passage formed therein and fluid communication with the secondary passage of the mixing valve, and a slide member movably mounted on the valve block, and slide member having first and second inlet channels and fluid communication with the first and second solution containers, respectively, wherein the first and second inlet channels can be selectively aligned with the transfer pasage in the valve block by moving the slide member to selectively establish a fluid path from the first and second solution containers to the mixing valve.

7. The carpet cleaning apparatus according to claim 1 wherein the wand is provided with a control valve actuator which includes a handle pivotedly mounted on the wand and a connecting rod interconnected between the control valve and the handle for moving the control valve between the cleaning position and the rinsing position.

8. The carpet cleaning apparatus according to claim 7 wherein the control valve includes a block and a slide member, and wherein the slide member is connected to the connecting rods so that the control valve actuator actually moves the slide member.

9. A method of cleaning and rinsing a carpet or other surface with a wand comprising the steps of:

(a) loading the wand with both a cleaning and rinsing solution and containing the cleaning and rinsing solutions in separate containers on the wand itself;

(b) directing hot water to the wand and through a hot water line associated with the wand;

(c) cleaning a selected area of the surface by directing cleaning solution from one container on the wand through a control valve into the hot water line to form a cleaning mixture;

(d) dispensing the cleaning mixture onto the selected area to be cleaned and thereafter vacuuming the cleaning mixture from the selected area;

(e) shutting off the flow of cleaning solution into the hot water line associated with the wand;

(f) rinsing residual cleaning solution from the selected surface area with the wand by directing rinsing solution from the other container on the wand through the same control valve into the hot water line to form a rinsing mixture;

(g) dispensing the rinsing mixture onto the selected surface area and therafter vacuuming the rinsing mixture from the selected surface area so as to remove residual cleaning solution from that area; and (h) shutting off the flow of rinsing solution to the hot water line and repeating the above cleaning and rinsing cycles on other selected surface areas whereby the method enables a carpet or other surface to be cleaned and rinsed by the very same wind in one basic operation.

10. A wand/type carpet and surface apparatus for cleaning and rinsing a surface comprising: a wand having a frame structure; a cleaning solution container mounted to the frame structure of the wand; a rinsing solution container mounted to the frame structure of the wand; hot water supply means mounted on the wand frame structure; control valve means mounted on the wand frame structure for mixing either a cleaning solution from the cleaning solution container with hot water passing from the hot water supply means or mixing a rinsing solution from the rinsing solution container with hot water passing from the hot water supply means; said control valve being movable between a cleaning position and a rinsing postition and wherein in the cleaning position the control valve is operative to mix cleaning solution with the hot water while in the rinsing position the control valve is operative to mix rinsing solution with hot water from the hot water supply means; and dispensing means for dispensing either the mixing cleaning solution in hot water or the mixed rinsing solution in hot water.

* * * * *